United States Patent [19]

Mulcahy

[11] Patent Number: 4,561,360

[45] Date of Patent: Dec. 31, 1985

[54] SINGLE AXLE SUSPENSION SYSTEM FOR RAILROAD VEHICLE

[75] Inventor: Harry W. Mulcahy, Griffith, Ind.

[73] Assignee: AMSTED Industries Incorporated, Chicago, Ill.

[21] Appl. No.: 617,752

[22] Filed: Jun. 6, 1984

[51] Int. Cl.[4] ..... B61F 3/00

[52] U.S. Cl. ..... 105/199 S; 105/218 R

[58] Field of Search ..... 105/199 S, 218 R, 224 R, 105/199 F, 222, 157 R

[56] References Cited

U.S. PATENT DOCUMENTS

| | | | |
|---|---|---|---|
| 2,963,987 | 12/1960 | Cottrell | 105/157 R |
| 3,286,653 | 11/1966 | Weber | 105/222 |
| 3,682,102 | 8/1972 | Pocklington et al. | 105/199 S |
| 4,109,586 | 8/1978 | Briggs et al. | 105/222 |

FOREIGN PATENT DOCUMENTS

| | | | |
|---|---|---|---|
| 960899 | 3/1957 | Fed. Rep. of Germany | 105/224 R |

*Primary Examiner*—Harry B. Tanner

*Attorney, Agent, or Firm*—Edward J. Brosius; Charles E. Bouton

[57] ABSTRACT

A railway wheel and axle assembly comprises a journal box with spaced wings extending longitudinally of the railway vehicle away from the axle. Springs supported by said wings accommodate relative lateral, longitudinal, vertical, yaw, pitch and roll movement between the vehicle body and the wheel and axle assembly. The wings comprise brackets longitudinally beyond the springs, and the vehicle body comprises a bracket above and laterally of each wing bracket and aligned therewith for attachment of a single axial displacement damper for damping such movement.

5 Claims, 3 Drawing Figures

SINGLE AXLE SUSPENSION SYSTEM FOR RAILROAD VEHICLE

This invention relates to a single axle suspension for railway vehicles and more particularly to a novel suspension wherein the vehicle body is entirely spring-mounted and damped from the journal boxes of a wheel and axle assembly.

A primary object of the invention is to devise such a mounting wherein the vehicle body is afforded a multi-degree of freedom of movement such as lateral, longitudinal, vertical, yaw, pitch and roll relative to the supporting wheel and axle assembly and wherein all such movement is controlled by single axial displacement dampers.

A more specific object of the invention is to provide wings on each journal box having seats for springs which support the vehicle body and having brackets longitudinally beyond such seats for attachment to the lower ends of dampers, the upper ends of which are attached to similar brackets on the vehicle body.

Still another object of the invention is to align each journal box bracket below and laterally with the related vehicle body bracket to afford great sensitivity to all of the various relative movements between the vehicle body and the wheel and axle assembly.

Yet another object of the invention is to provide two dampers for each journal box, each damper being disposed longitudinally beyond one spring seat so that each axle end is straddled by two spring seats and two dampers.

The foregoing and other objects and advantages of the invention will become apparent from the following specification and the accompanying drawings wherein.

In each of said views, portions of the vehicle may be broken away in the interest of clarity.

Figure 1:
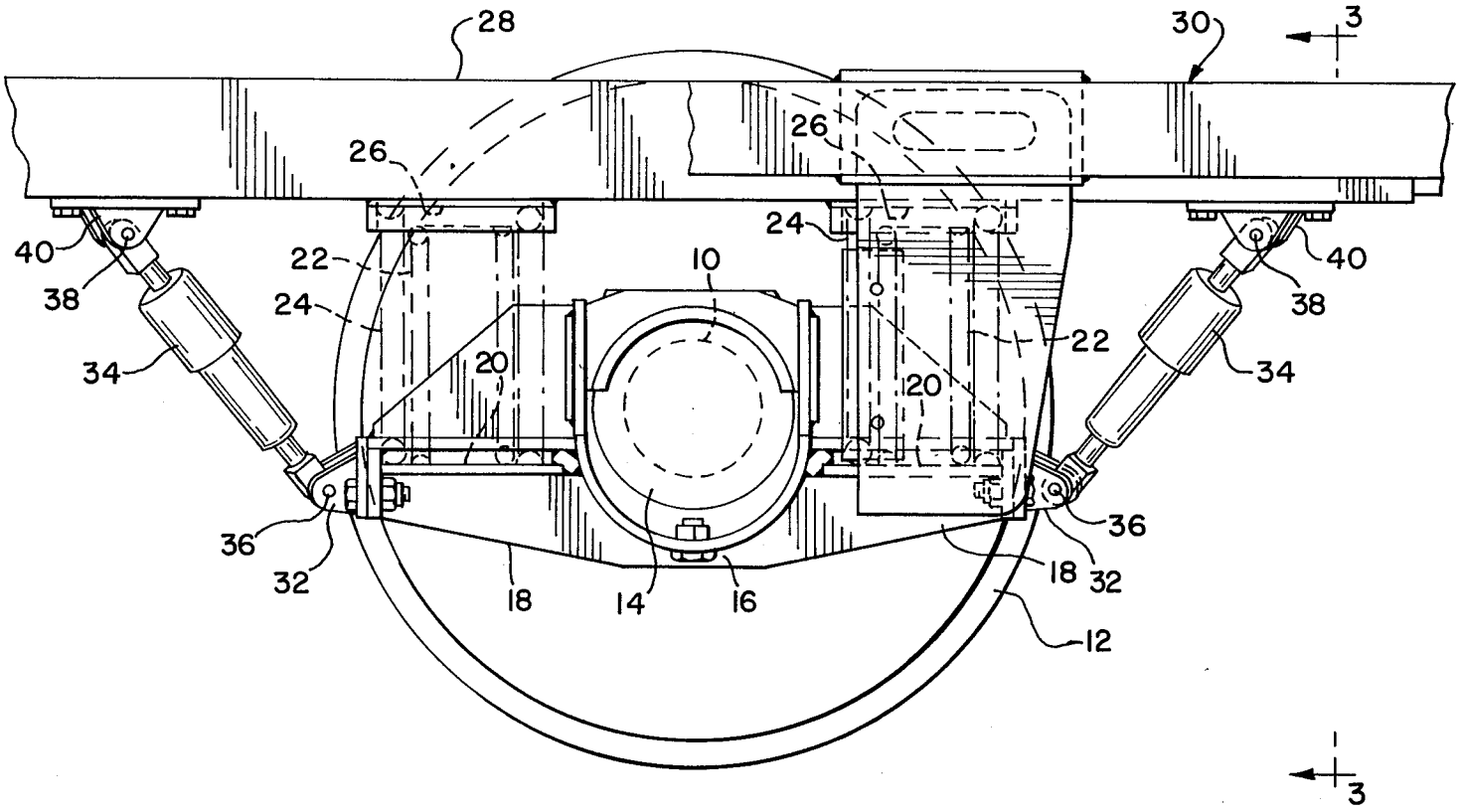
FIG. 1 is a fragmentary side elevational view of a railway vehicle embodying a preferred form of the invention.

Describing the invention in detail and referring first to FIG. 1, the invention is disclosed as applied to a single axle suspension system for a railway vehicle comprising a conventional wheelset including an axle 10 with a wheel 12 mounted adjacent each end thereof. Only one end of the axle and its related wheel is shown in the drawings although it will be understood that the vehicle is symmetrical about its longitudinal axis so that each end of the axle is mounted in roller bearings 14 contained within a roller bearing journal box 16 which comprises novel longitudinally extending members or wings 18 each having a spring seat 20 supporting inner and outer coil springs 22 and 24 preferably dual rate in design with the outer coil 24 having a greater free height than its contained inner coil 22.

The spring group 22, 24 on each seat 20 bears against a spring seat 26 on a longitudinally extending member 28 of a vehicle body generally designated 30.

Each wing 18 extends longitudinally of the vehicle beyond the wing's spring seat 20 to define a bracket or jaw 32 within which the lower end of a damper 34 is attached as by a conventional pin and clevis joint at 36, the upper end of the damper being similarly attached as at 38 to a similar bracket or jaw 40 on the underside of the car body member 28.

Figure 2:
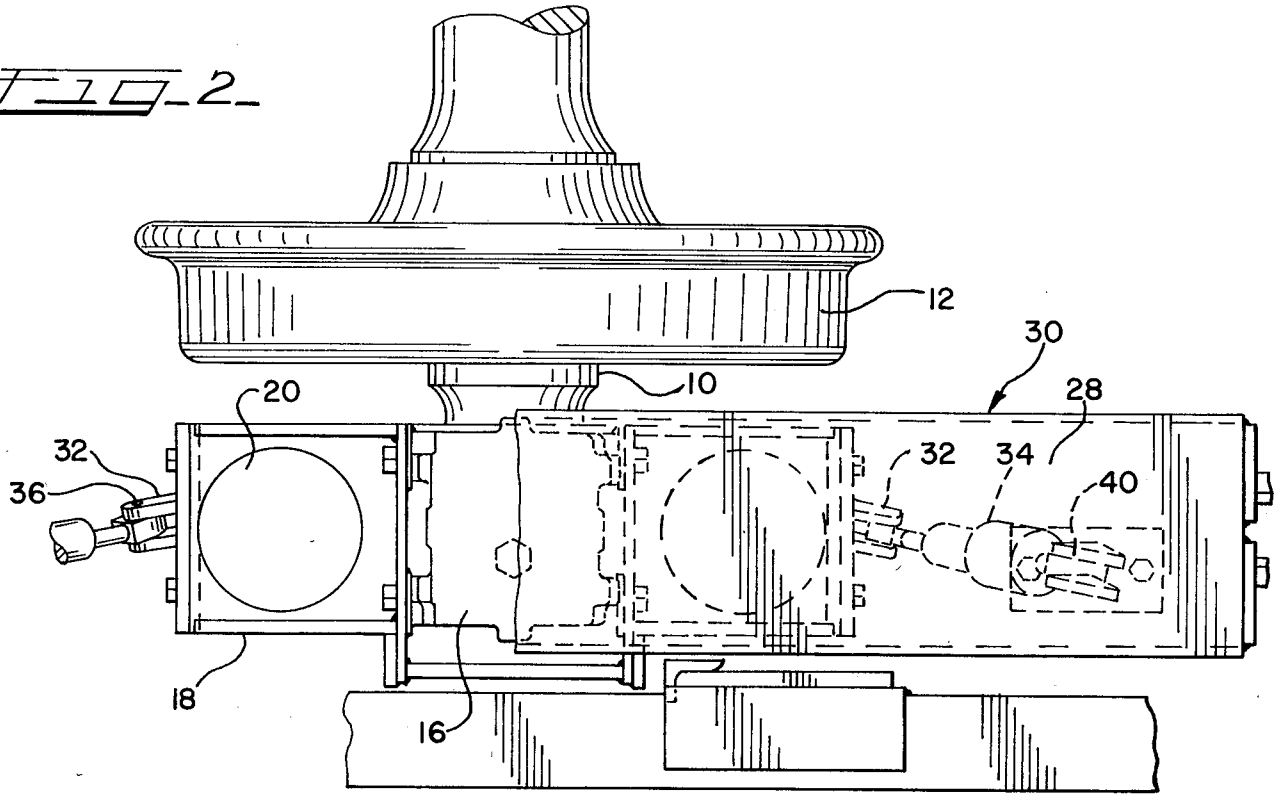
FIG. 2 is a fragmentary top plan view of the structure shown in FIG. 1.
Figure 3:
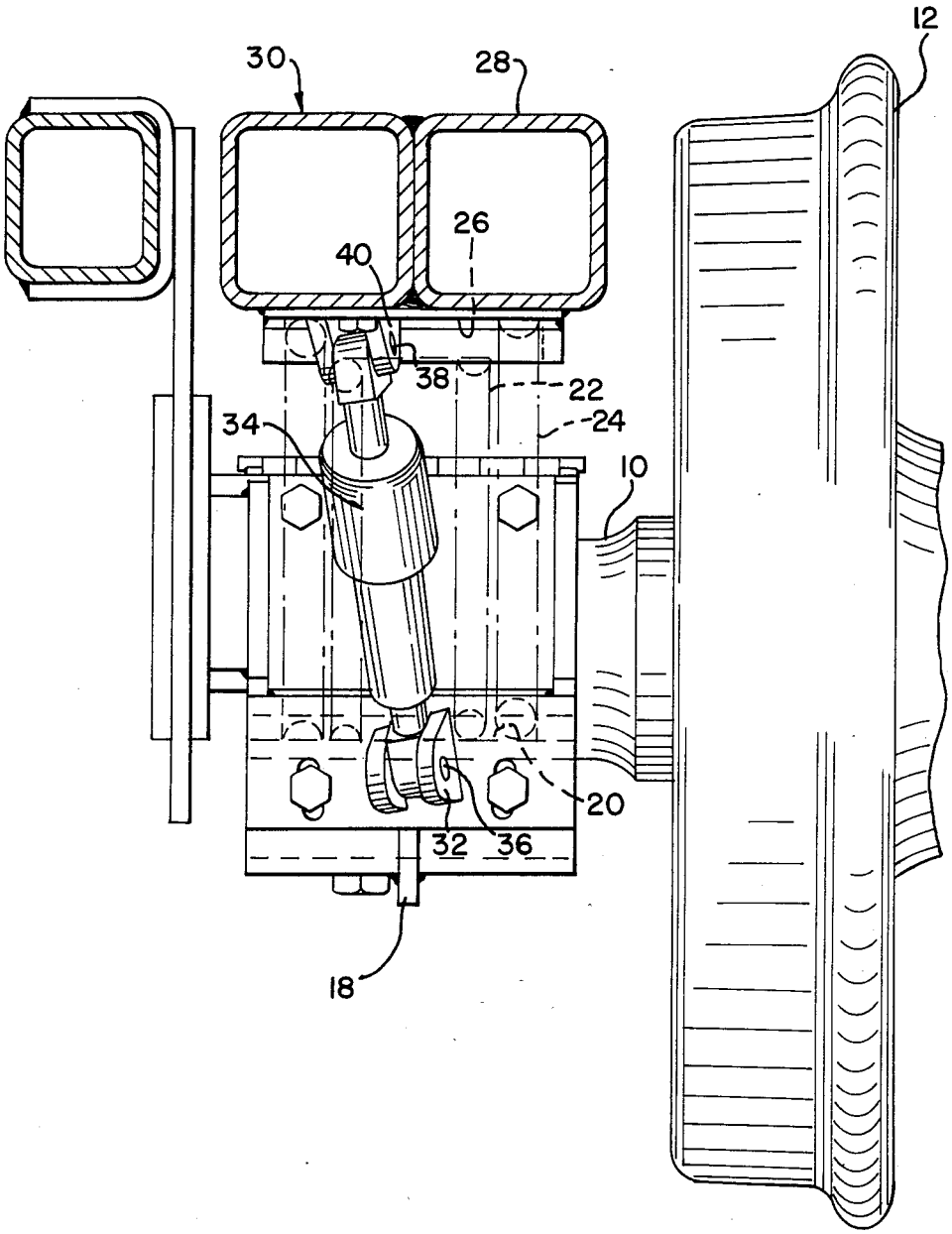
FIG. 3 is a sectional view taken on line 3—3 of FIG. 1.

It is noted that the jaws 32 and 40 are diagonally arranged but aligned, with the jaw 32 laterally of the jaw 40 and below the jaw 40 so that relative movement between the jaws in any direction or combination of directions causes the damper to be subjected to axial displacement which is resisted internally of the damper by a hydraulic friction device (not shown) in which hydraulic fluid is forced through an orifice or orifices or by a mechanical friction device (not shown) in which friction parts are rubbed together under pressure. The relationship between brackets 32 and 40 is best seen in FIG. 3 but it will be understood that the brackets 32 and 40 at the left end as seen in FIGS. 1 and 2 are also diagonally aligned with bracket 32 laterally of bracket 40 so that the related damper 34 is very sensitive to and axially displaced by any relative movement between the jaws to which it is connected.

It will also be understood that the support and damping of the vehicle body 30 at the opposite end of the axle 10 (not shown) is similar to that shown in the drawings because the vehicle is, as heretofore stated, preferably symmetrical about its longitudinal axis.

In operation of the vehicle the body 30 is accommodated lateral, longitudinal, yaw, roll, pitch and vertical movement relative to the wheel axle assembly 10, 12 with stiffness provided by the coil springs 22, 24. The inclination of the dampers 34 provide appropriate damping for each of the several stiffnesses throughout their entire ranges of load variation. The coil springs, of course, may be single, multi-rate, or variable rate in design and the dampers 34 may be identical or variable in characteristics but it is preferable that they be identical for ease and safety of interchange in service.

What is claimed is:

1. In a railway vehicle, a vehicle body, a wheel and axle assembly having a journal box with spaced wings extending longitudinally of the body beyond said axle, spring seats on respective wings disposed longitudinally of the body beyond said axle at opposite sides thereof, spring means on said seats for supporting said body to accommodate relative lateral, longitudinal, vertical, yaw, pitch and roll movement between said assembly and said body, brackets on respective wings, said seats being disposed between said brackets, brackets on said body above respective wing brackets and aligned therewith, each wing bracket being disposed laterally of its related body bracket, and a single axial displacement damper connected diagonally to each wing bracket and the body bracket thereabove to damp such movement.

2. In a suspension for a railway vehicle, a wheel and axle assembly comprising journal boxes at its ends, wings on each box extending longitudinally of the vehicle, spring means on said wings, a car support structure supported by said spring means, brackets on said journal boxes, brackets on said structure above respective journal box brackets, and means diagonally connected between each journal box bracket and its related car support structure bracket for damping movement toward and away from each other.

3. In a single axle suspension for a railroad vehicle, the combination of a wheel and axle assembly comprising journal boxes at its respective ends, spring means carried by the journal boxes to either side of the axle for supporting the vehicle and for accommodating longitudinal, lateral, yaw, roll, pitch and vertical movement of the vehicle relative to the assembly, and single axial displacement damper means connected at its ends relatively outwardly of said spring means and diagonally between a journal box and to the vehicle for damping longitudinal, lateral, roll, yaw, pitch and vertical movement of the vehicle relative to the assembly.

4. A suspension according to claim 3 wherein the damper means have a displacement axis which slopes downwardly both longitudinally and laterally of the vehicle.

5. A suspension according to claim 3 wherein the spring means are disposed at opposite sides of the assembly and wherein each spring means comprise an outer coil and an inner coil having a lesser free height than said outer coil.

* * * * *